US007588491B2

(12) United States Patent
Harada et al.

(10) Patent No.: US 7,588,491 B2
(45) Date of Patent: Sep. 15, 2009

(54) COIN PROCESSING DEVICE

(75) Inventors: Tsuyoshi Harada, Hatagaya (JP); Shoichi Uda, Tokyo (JP)

(73) Assignee: Laurel Precision Machines Co., Ltd., Osaka-shi (JP)

( * ) Notice: Subject to any disclaimer, the term of this patent is extended or adjusted under 35 U.S.C. 154(b) by 0 days.

(21) Appl. No.: 11/643,984

(22) Filed: Dec. 22, 2006

(65) Prior Publication Data

US 2007/0144864 A1 Jun. 28, 2007

(30) Foreign Application Priority Data

Dec. 26, 2005 (JP) ..... P2005-372066

(51) Int. Cl.
*G07D 3/00* (2006.01)
*G07D 3/14* (2006.01)

(52) U.S. Cl. ..... 453/3

(58) Field of Classification Search ..... 453/3, 453/4, 7, 11, 15, 56; 209/363, 364, 606
See application file for complete search history.

(56) References Cited

U.S. PATENT DOCUMENTS

| | | | | |
|---|---|---|---|---|
| 4,558,712 | A | 12/1985 | Sentoku et al. | |
| 4,625,851 | A * | 12/1986 | Johnson et al. | 194/200 |
| 4,718,660 | A * | 1/1988 | Daboub | 271/305 |
| 5,059,153 | A * | 10/1991 | Goi | 453/11 |
| 6,030,284 | A | 2/2000 | Frank | |
| 6,629,885 | B1 | 10/2003 | Tsuruda et al. | |
| 2004/0256197 | A1 | 12/2004 | Blake et al. | |

FOREIGN PATENT DOCUMENTS

| | | | |
|---|---|---|---|
| DE | 3627387 | A1 * | 2/1988 |
| JP | 2-18182 | | 2/1990 |
| JP | 2005-174072 | | 6/2005 |
| TW | 300655 | | 3/1997 |
| TW | 359804 | | 6/1999 |
| TW | 476050 | | 2/2002 |
| WO | WO 97/07485 | | 2/1997 |

OTHER PUBLICATIONS

Search Report and Notice of Allowance for corresponding Taiwanese Application No. 095146882, issued Apr. 13, 2009, with English Translation, 6 pages.

* cited by examiner

*Primary Examiner*—Patrick Mackey
*Assistant Examiner*—Mark Beauchine
(74) *Attorney, Agent, or Firm*—Nixon & Vanderhye P.C.

(57) ABSTRACT

A coin processing device includes: a passage along which a coin is transferred from an upstream-end toward a downstream-end thereof; an opening formed on the passage; a gate including a guide section that constitutes a part of the passage while the opening is closed and has a stepped portion formed at a portion of the guide section which is closer to the downstream-end of the passage, the gate being tilted so as to lift a portion thereof which is closer to the upstream-end of the passage in a state where the opening is closed to open the opening; and a gate mechanism for causing the coin to fall though the opening by tilting the gate. In this coin processing device, while the gate is open, the stepped portion receives a portion of the coin in the direction of the upstream.

2 Claims, 4 Drawing Sheets

COIN PROCESSING DEVICE

BACKGROUND OF THE INVENTION

1. Field of the Invention

The present invention relates to coin processing devices for performing processing, such as identification and counting, of inserted coins, and in particular to high-speed coin processing by such coin processing devices.

This application claims priority from Japanese Patent Application No. 2005-372066, filed on Dec. 26, 2005, the contents of which are incorporated herein by reference.

2. Description of Related Art

Coin processing devices for performing processing, such as identification and counting, of inserted coins are known.

Some of such coin processing devices include a gate mechanism at an opening formed on a transfer passage along which inserted coins are transferred so that the coins are guided into the opening by opening or closing the gate.

One of such coin processing devices is disclosed in Japanese Unexamined Utility Model Application, First Publication No. H02-18182.

The above-described coin processing device will be described in detail with reference to FIG. 4.

Referring to FIG. 4, a coin processing device includes a transfer passage 101 along which a coin C is transferred in a direction indicated by arrow A in FIG. 4 and a feed belt B arranged along this transfer passage 101.

An opening 102 through which the coin C falls is formed at an intermediate point of this transfer passage 101, and a gate 105 having an upper wall 103 and a lower wall 104 is provided at this opening 102.

This gate 105 is rotatably supported slightly below an upstream-end periphery of the opening 102 and is tiltable toward inside of the opening 102 from a position at which an upper surface of the lower wall 104 is flush with an upper surface of the transfer passage 101.

Therefore, when the gate 105 is in a closed state, the coin C transferred from upstream of the transfer passage 101 by driving the feed belt B is guided onto the upper surface of the lower wall 104 and sent to downstream of the transfer passage 101.

On the other hand, in an open state of the gate 105 where a downstream-end portion of the gate 105 is tilted downward, the transferred coin C is guided between the upper wall 103 and the lower wall 104, striking a lower surface of the upper wall 103 in some cases, into the opening 102.

Provided with the upper wall 103, the above-described gate 105 is complicated in shape and costly, though the coin C can be guided into the opening 102 reliably.

For coin processing devices including a gate support point adjacent to a downstream-end of an opening in order to make the devices simple in structure and less expensive, the functions of both an upper wall and a lower wall can be realized with a lower wall alone.

This simplified version of a gate mechanism will be described with reference to the drawings.

Referring to FIGS. 5A and 5B, an opening 102 formed on a transfer passage 101 is provided with a gate 105A that is rotatably supported by a support shaft 105*a* slightly below a downstream-end periphery of this opening 102.

The gate 105A extends upward at an oblique angle from a base thereof toward upstream of the opening 102 and includes a guide plate 107 which is formed in a curve from a position flush with an upper surface of the transfer passage 101 toward the upstream-end. The guide plate 107 includes a slit 106 extending in the transfer direction at a substantially central position in the width direction thereof.

Because of this slit 106, the guide plate 107 is prevented from interfering with a feed belt B even when the gate 105A is tilted to cause an upstream-end thereof to rise.

With this structure, when the gate 105A is in a closed state, the coin C transferred along the transfer passage 101 is guided onto an upper surface of the guide plate 107 toward the downstream-end of the transfer passage 101.

On the other hand, when the gate 105A is in an open state, the transferred coin C is guided to below the guide plate 107, striking a lower surface of the guide plate 107 in some cases, into the opening 102.

In short, with the simplified gate 105A without an upper wall, the coin C can be guided into the opening 102 in the same manner as with the above-described gate 105.

In recent years, there are growing demands for increased throughput of coin processing devices.

One approach to enhancing the throughput of such a coin processing device is, for example, to reduce the intervals at which the coins C are transferred (hereinafter, referred to just as the transfer interval) to increase the number of coins that can be processed per unit of time.

In the above-described coin processing device including the gate 105A, however, when the gate 105A is tilted to enter the open state while the transferred coin C resides on the gate 105A, the gate 105A lifts the coin C, which presses up the feed belt B, possibly causing the coin to jam.

For this reason, a certain transfer interval d102 and a certain transfer pitch d101 for coins C, as indicated in FIG. 5A, need to be secured in order to prevent the coin C from being lifted by the gate 105A. In other words, in the known coin processing device including the gate 105A, there is a problem in that the transfer intervals cannot be shorter than that specified in FIG. 5A, and therefore, no further improvement in throughput by reducing the transfer intervals can be made.

SUMMARY OF THE INVENTION

An object of this invention is to provide a coin processing device that can increase the throughput by reducing the coin transfer interval without making the device complicated.

In order to achieve the above-described object, a coin processing device according to this invention includes. a passage along which a coin is transferred from an upstream-end toward a downstream-end thereof; an opening formed on the passage; a gate including a guide section that constitutes a part of the passage while the opening is closed and has a stepped portion formed at a portion of the guide section which is closer to the downstream-end of the passage, the gate being tilted so as to lift a portion thereof which is closer to the upstream-end of the passage in a state where the opening is closed to open the opening, and a gate mechanism for causing the coin to fall though the opening by tilting the gate. In this coin processing device, while the gate is open, the stepped portion receives a portion of the coin in the direction of the upstream.

According to the coin processing device of this invention, even if the gate is tilted to lift the portion thereof which is closer to the upstream-end of the passage while the portion of the coin in the direction of the upstream is on the gate, the stepped portion of the gate receives the portion of the coin in the direction of the upstream.

In other words, the portion of the coin in the direction of the upstream fits on the stepped portion, and therefore, the gate does not press up the coin.

For this reason, the transfer interval of coins can be reduced by the amount of the length of the stepped portion.

Consequently, the throughput of the device can be improved without making the device complicated.

It is preferable that the coin processing device further include: a sensor disposed so as to detect a portion of the coin which is closer to the downstream-end of the passage, the portion of the coin having passed through the gate; and a control unit for tilting the gate not earlier than a point in time when the portion of the coin which is closer to the upstream-end of the passage is receivable in the stepped portion based on a detection result by the sensor.

According to the coin processing device of this invention, open/close control of the gate can be performed with high accuracy based on detection by the sensor at an appropriate point in time to prevent the coin disposed at a portion of the gate mechanism which is closer to the downstream-end of the passage from being pressed up by the gate. Therefore, the transfer interval can be made as short as possible.

Consequently, the throughput can be further improved without compromising the reliability.

DETAILED DESCRIPTION OF THE INVENTION

A coin processing device according to one embodiment of this invention will be described with reference to the drawings.

Figure 1:
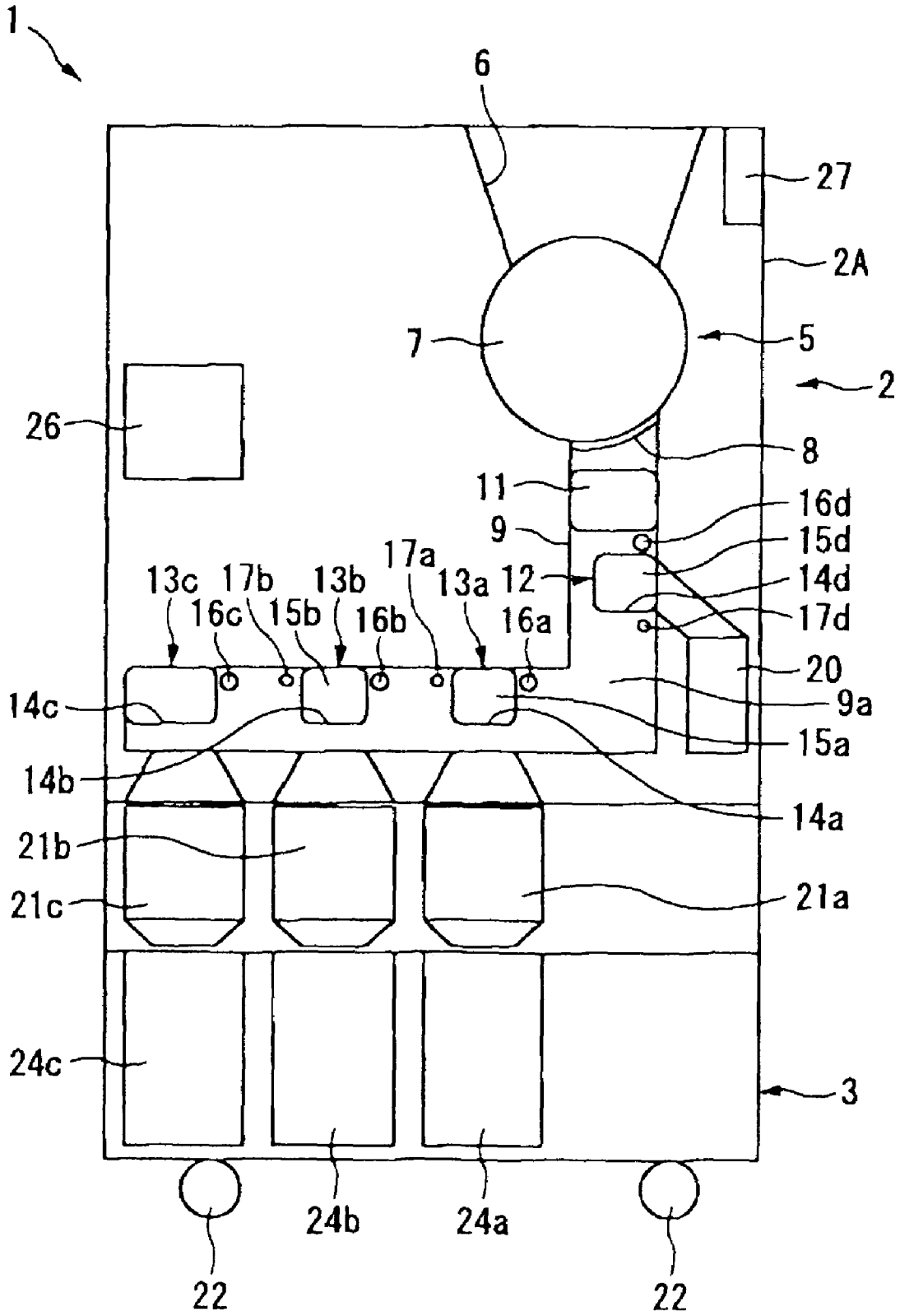
FIG. 1 is a schematic side view of an overall structure of a coin processing device according to one embodiment of this invention.

FIG. 1 schematically shows a coin processing device 1 according to this embodiment.

The coin processing device 1 includes a device main body 2 and a cart 3 that is attachable to and detachable from this device main body 2.

In the current description, the terms "front," "rear," "left," and "right" correspond to the front (near side of an operator) of the coin processing device 1, the rear (far side of the operator) of the coin processing device 1, the left (left side when viewed from the operator) of the coin processing device 1, and the right (right side when viewed from the operator) of the coin processing device 1, respectively.

The device main body 2 includes, in an upper section thereof, a separating/feeding unit 5 for separating a batch of delivered coins and feeding them one by one.

This separating/feeding unit 5 includes a hopper 6, a rotatable disc 7, a coin separating unit 8, and a coin transfer section 9.

A batch of coins are delivered into the hopper 6.

The rotatable disc 7 is disposed below the hopper 6 so as to form a bottom portion of the hopper 6 and can spin horizontally.

The coin separating unit 8 includes an opening through which only one coin can pass to deliver the coins one at a time using the centrifugal force of the rotating rotatable disc 7.

The coins delivered one at a time by the coin separating unit 8 are horizontally transferred by the coin transfer section 9 on a passage 9*a* at predetermined intervals.

Furthermore, adjacent to an upstream-end of the coin transfer section 9, the device main body 2 includes an identifying unit 11 for determining the genuine or counterfeit nature and the denomination of coins being transferred by the coin transfer section 9 and for counting these coins.

A reject unit (gate mechanisms) 12 for excluding rejected coins determined as not genuine based on a determination result by this identifying unit 11 is provided downstream of the identifying unit 11 in the coin transfer section 9.

Furthermore, downstream of the reject unit 12 in the coin transfer section 9, sorting units (gate mechanisms) 13*a*, 13*b*, and 13*c* for sorting coins determined as genuine and acceptable based on a determination result by the identifying unit 11 are provided at a plurality of (more specifically, three) positions in that order along the transfer direction of the coin transfer section 9.

All the sorting units 13*a*, 13*b*, and 13*c* include, on the passage 9*a*, sorting-out holes (openings) 14*a*, 14*b*, and 14*c*, respectively, through which the largest diameter coin (500 yen coin in Japan) can fall.

Of these three sorting units, the upstream two sorting units 13*a* and 13*b* include gates 15*a* and 15*b*, respectively, that can open and close the sorting-out holes 14*a* and 14*b*, respectively.

In addition, reach sensors 16*a*, 16*b*, and 16*c* for detecting the arrival of a coin are provided upstream of the sorting units 13*a*, 13*b*, and 13*c*, respectively.

Passage sensors (sensors) 17*a* and 17*b* for detecting the passing of a coin are provided downstream of the sorting units 13*a* and 13*b*, respectively, disposed at intermediate points of the coin transfer section 9.

Similarly, the reject unit 12 includes a reject hole 14*d*, a gate 15*d* that can open and close the reject hole 14*d*, a reach sensor 16*d* which is closer to the upstream-end of the coin transfer section 9, and a passage sensor 17*d* which is closer to the downstream-end of the coin transfer section 9.

The reach sensors 16*a*, 16*b*, and 16*d* and the passage sensors 17*a*, 17*b*, and 17*d* are used to control the open/close timing of the respective gates 15*a*, 15*b*, and 15*d* and also to detect whether a coin jams in the respective gates 15*a*, 15*b*, and 15*d*.

The device main body 2 further includes a detachable reject box 20 for receiving from the coin transfer section 9 those coins excluded by the reject unit 12; and temporary retention units 21*a*, 21*b*, and 21*c* that are provided at a plurality of (more specifically, three) positions for the sorting units 13*a*, 13*b*, 13*c*, respectively, to temporarily reserve coins sorted by the respective sorting units 13*a*, 13*b*, and 13*c*.

When temporarily reserved coins are to be returned, the temporary retention units 21*a*, 21*b*, and 21*c* are integrally withdrawn from the device main body 2.

The most upstream temporary retention unit 21*a* is disposed below the most upstream sorting unit 13*a* and, as a result of the gate 15*a* of this sorting unit 13*a* being opened, receives only coins falling through the sorting-out hole 14*a* for temporal retention.

The middle temporary retention unit 21*b* is disposed below the middle sorting unit 13*b* and, as a result of the gate 15*b* of this sorting unit 13*b* being opened, receives only coins falling through the sorting-out hole 14*b* for temporary retention.

The most downstream temporary retention unit 21*c* is disposed below the most downstream sorting unit 13*c* and receives only coins failing through the sorting-out hole 14*c* for temporal retention.

The cart 3 is withdrawn toward a front face 2A of the device main body 2 by means of rolling casters 22 provided therebelow and is detached from the device main body 2 for transportation.

Furthermore, the cart 3 is docked on the device main body 2 from the front face 2A side.

The cart 3 includes a plurality of (more specifically, three) storage boxes 24*a*, 24*b*, and 24*c* arranged in line along the front/back direction.

These storage boxes 24*a*, 24*b*, and 24*c* are provided directly below the plurality of temporary retention units 21*a*, 21*b*, and 21*c*, respectively, of the device main body 2.

The storage boxes 24*a*, 24*b*, and 24*c* receive coins as described below.

Only coins temporarily reserved in the temporary retention unit 21*a* are received by the storage box 24*a* to accommodate them by opening the bottom portion of the temporary retention unit 21*a*.

Only coins temporarily reserved in the temporary retention unit 21*b* are received by the storage box 24*b* to accommodate them by opening the bottom portion of the temporary retention unit 21*b*.

Only coins temporarily reserved in the temporary retention unit 21*c* are received by the storage box 24*c* to accommodate them by opening the bottom portion of the temporary retention unit 21*c*.

Moreover, the device main body 2 includes a control unit 26 and a display/operation unit 27.

The control unit 26 controls the driving of the separating/feeding unit 5 and individually controls the gates 15*a* and 15*b* of the sorting units 13*a* and 13*b* and the gate 15*d* of the reject unit 12 based on a determination result by the identifying unit 11 and detection results by the reach sensors 16*a*, 16*b*, and 16*d*.

The display/operation unit 27 presents the operator with visual information and receives input by the operator.

The above-described reject unit 12 and the sorting units 13*a* and 13*b* will be described below in detail with reference to FIGS. 2A and 2B.

Since the reject unit 12 and the sorting units 13*a* and 13*b* have the same structure. this embodiment is described by way of example of the sorting unit 13*a*.

Figure 2A:
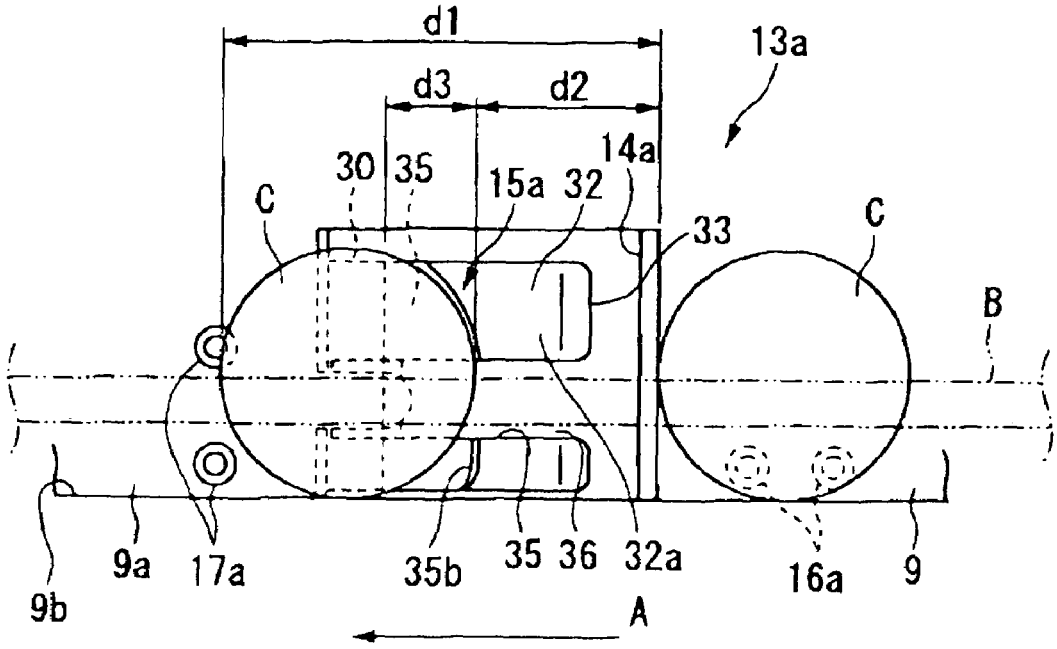
FIG. 2A is a plan view of a gate in a closed state, schematically showing a sorting unit of a coin processing device according to one embodiment of this invention.
Figure 2B:
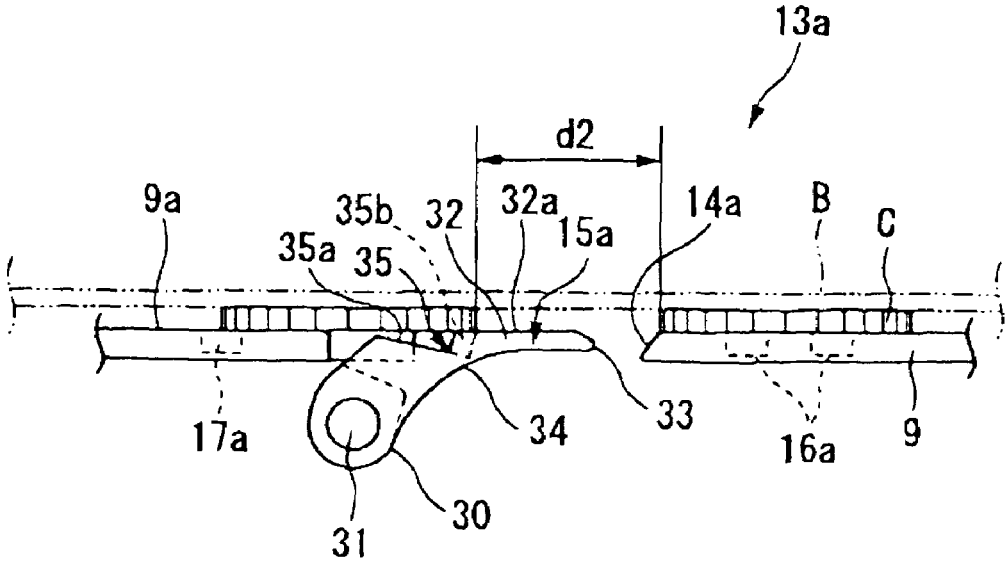
FIG. 2B is a side view of a gate in a closed state, schematically showing a sorting unit of a coin processing device according to one embodiment of this invention.

Referring to FIGS. 2A and 2B, the coin transfer section 9 includes a feed belt B above the passage 9*a*, and this feed belt B extends along a direction indicated by arrow A in FIG. 2A, which is the transfer direction of the coin transfer section 9.

Interposed between this feed belt B and the upper surface of the passage 9*a*, a coin C is transferred on the passage 9*a* as the feed belt B is rotationally driven.

As described above, the sorting-out hole 14*a* is formed on the passage 9*a*, and the gate 15*a* is tiltably disposed at this sorting-out hole 14*a*.

Tilting of this gate 15*a* is controlled by, for example, an actuator (not shown) based on a control command from the control unit 26.

More specifically, the gate 15*a* includes a shaft 31 extending in the width direction of the passage 9*a* and is supported slightly below a periphery of the sorting-out hole 14*a* which is closer to the downstream-end of the passage 9*a*, and a driving source such as an actuator is connected to this shaft 31.

The gate 15*a* further includes a guide plate (guide section) 32.

When the gate 15*a* is in a closed state, the guide plate 32 extends upward at an oblique angle from a base 30 adjacent to the shaft 31 toward the upstream-end of the passage 9*a*, and furthermore, the upper surface of the guide plate 32 extends horizontally from a point flush with the upper surface of the coin transfer section 9 toward the upstream-end of the passage 9*a*, whereas the lower surface of the guide plate 32 rises in a curve whose tangential gradient becomes gradually moderate toward the upstream-end of the passage 9*a*.

A transfer surface 32*a* that is flush with the upper surface of the passage 9*a* while the gate 15*a* is in a closed state is formed on a portion of the upper surface of this guide plate 32 which is closer to the upstream-end of the passage 9*a*, and this transfer surface 32*a* constitutes the transfer passage together with the passage 9*a*.

On the other hand, the lower surface of the guide plate 32 constitutes a guide surface 34, substantially arc in sectional view, whose tangential gradient becomes gradually moderate from the base 30 toward an upstream edge 33 of this guide plate 32.

By providing the guide surface 34 on the lower surface of the guide plate 32 in this manner, the transferred coin C, even after striking the guide surface 34 which is substantially arc in sectional view, smoothly falls into the sorting-out hole 14*a* by preventing the front end thereof from being caught.

Furthermore, a slit 36 slightly wider than the feed belt B is formed on the guide plate 32 at a position corresponding to the feed belt B.

By providing this slit 36, the guide plate 32 does not interfere with the feed belt B even though the gate 15*a* tilts about the shaft 31 to enter an open state.

Figure 3:
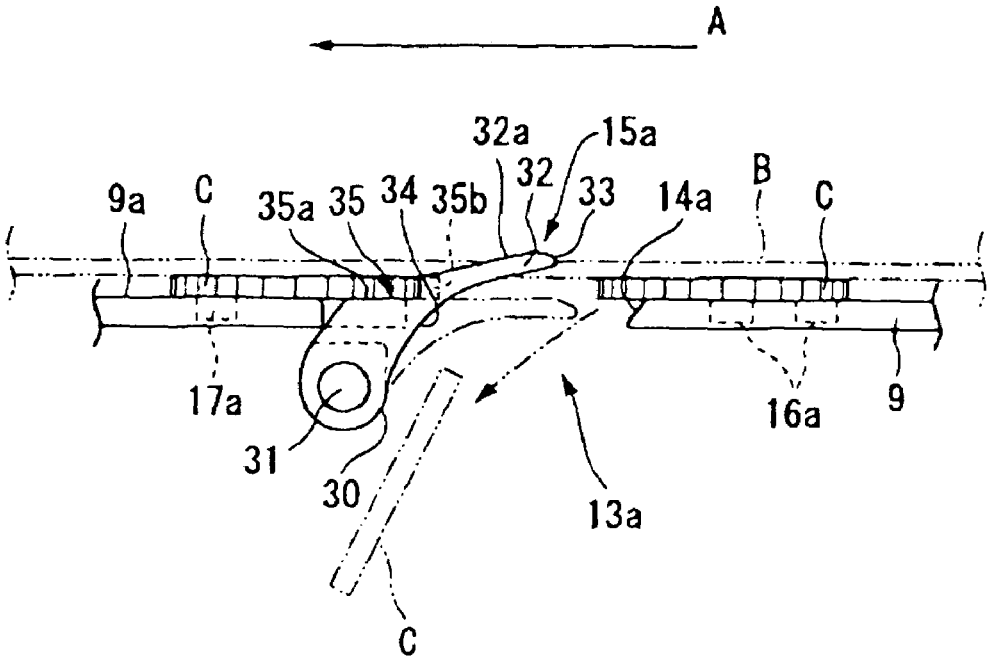
FIG. 3 is a side view of a gate in an open state, schematically showing a sorting unit of a coin processing device according to one embodiment of this invention.
Figure 4:
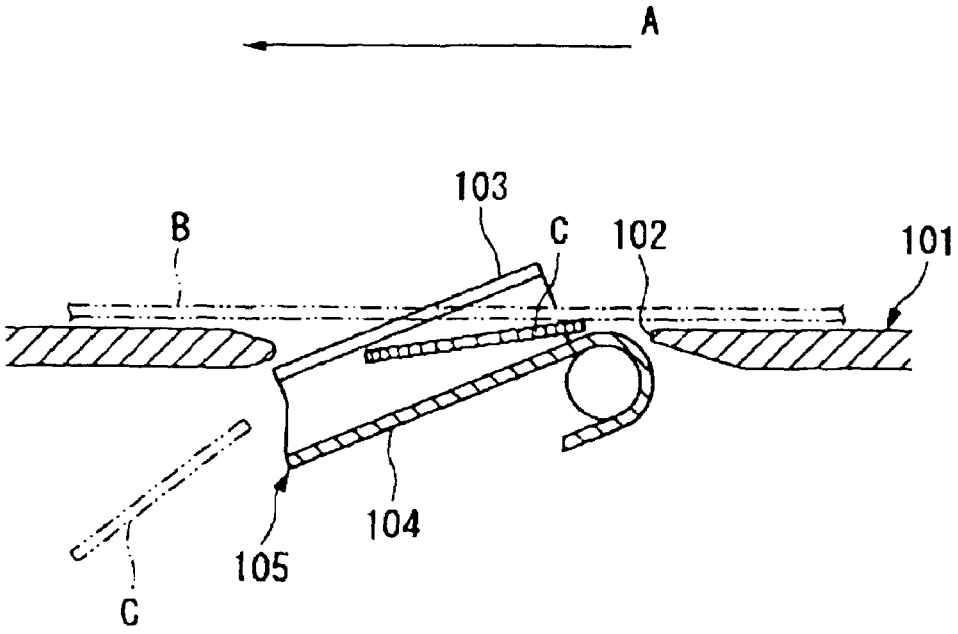
FIG. 4 is a schematic cross-sectional view of a gate of a known coin processing device.

Referring to FIG. 3, a stepped portion 35 is formed at a portion of the upper surface of the guide plate 32 which is closer to the downstream-end of the passage 9*a*.

This stepped portion 35 is formed so as to receive a portion (e.g., about one-third area at the upstream end) of the coin C in the direction of the upstream while the gate 15*a* is in an open state.

Even when the gate 15*a* is an open state, the guide plate 32 does not press up (i.e., toward the feed belt B) an upstream portion of the coin C by virtue of the stepped portion 35.

More specifically, the above-described stepped portion 35 includes a bottom surface 35*a* which is substantially flush with the upper surface of the passage 9*a* when the gate 15*a* is in an open state and a longitudinal surface 35*b* extending substantially perpendicular to this bottom surface 35*a*.

This longitudinal surface 35*b* is formed to be substantially arc in plan view (as shown in FIG. 2A) whose diameter is slightly greater than the outer diameter of the coin C. Furthermore, the longitudinal surface 35*b* has a height substantially equal to the thickness of the coin C.

Although the height of the longitudinal surface 35*b* is not limited to the thickness of the coin C, it is preferable that the height of the longitudinal surface 35*b* be greater than the thickness of the coin C.

On a portion of the sorting unit 13*a* which is closer to the upstream-end of the coin transfer section 9, two reach sensors 16*a* are provided to the left in the transfer direction (lower side on the drawing of FIG. 2A), arranged in line along the transfer direction.

As described above, these reach sensors 16*a* detect the coin C transferred from upstream with different timings.

By providing the two reach sensors 16*a* to the left of the feed belt B side by side in the transfer direction as described above, in which direction (i.e., upstream or downstream) the coin C travels at these reach sensors 16*a* can be detected.

As a result, the coins passing by these reach sensors 16*a* can be counted for increment or decrement.

On the other hand, two passage sensors 17*a* are provided on a portion of the sorting unit 13*a* which is closer to the downstream-end of the coin transfer section 9.

One of these passage sensors 17*a* is provided at a substantially central position in the width direction of the coin transfer section 9, and the other passage sensor 17*a* is provided adjacent to a raised wall 9*b* disposed to the left in the transfer direction of the coin C in the coin transfer section 9. More specifically, these passage sensors 17*a* are arranged side by side along the width direction of the coin transfer section 9, interposing the locus of the feed belt B therebetween.

These passage sensors 17*a* can sense a downstream edge in the transfer direction, that is, the front end of the coin C to detect timing with which an upstream-end portion of the coin C guided and transferred by means of the raised wall 9*b* can be positioned in the stepped portion 35.

More specifically, these passage sensors 17*a* can detect that an upstream edge of a coin C with the largest diameter from among coins that are passing through the gate 15*a* for processing has reached an upstream edge, that is, the longitudinal surface 35*b* of the stepped portion 35.

Furthermore, by providing two passage sensors 17*a*, the transfer positions of coins C having different outer diameters can be detected.

The above-described reach sensors 16*a* and passage sensors 17*a* are connected to the control unit 26.

The control unit 26 determines the transfer position of the coin C, the transfer direction of the coin C, and so forth based on detection results by the reach sensors 16*a* and the passage sensors 17*a* and an identification result by the above-described identifying unit 11 to control the open/close timing of the gate 15*a*.

The operation of this embodiment will be described below.

First, individual coins put in the hopper 6 are delivered by the coin separating unit 8 to the coin transfer section 9 one at a time.

At this time, the transfer intervals of the coins C delivered one at a time need to be equal to or more than a length d2 in the state shown in FIGS. 2A and 2B.

The length d2 indicates the distance between the upstream edge (rear end) of a coin C that has passed by the sorting unit 13*a* and the downstream edge (front end), in the transfer direction, of the subsequent coin C (a coin that has not yet passed by the sorting unit 13*a*) at the time the downstream edge (front end), in the transfer direction, of the coin C that has passed by the sorting unit 13*a* reaches the passage sensors 17*a*.

In FIGS. 2A and 2B, the position of the subsequent coin C indicates a position closest possible to the sorting-out hole 14*a* so long as the coin C can be sorted into the sorting-out hole 14*a* by switching the gate 15*a* of the sorting unit 13*a* from the closed state to the open state.

If the coin C passing by the sorting unit 13*a* is a denomination having the smallest diameter from among coins to be processed, the transfer pitch is equal to a minimum required transfer pitch d1.

Put another way, the upstream edge of the stepped portion 35, that is, the position of the longitudinal surface 35*b* is set in accordance with the denomination having the largest diameter from among coins to be processed, and therefore, when the downstream edge (front end), in the transfer direction, of the coin C that has passed by the sorting unit 13*a* reaches the passage sensors 17*a*, the gate 15*a* does not press up the coin C passing by the sorting unit 13*a* for any length of time, irrespective of the gate 15*a* of the sorting unit 13*a* being switched from the closed state to the open state.

In addition, although the subsequent coin C continues to be transferred by means of the feed belt B also while the gate 15*a* of the sorting unit 13*a* is being switched from the closed state to the open state, a positional relationship that does not cause the downstream edge (front end) of the subsequent coin C to collide with the upstream edge 33 of the guide plate 32 of the gate 15*a* is maintained, as shown in FIG. 3, even after the gate 15*a* of the sorting unit 13*a* has been switched from the closed state to the open state. In short, a positional relationship indicated by the transfer interval d2 and the transfer pitch d1 is maintained.

Although, in this embodiment, the sorting unit 13*a* is used as a reference of the transfer interval for convenience of description, the reject unit 12 and the sorting unit 13*b* can also be used as a reference because the reject unit 12 and the sorting unit 13*b* have the same structure as that of the sorting unit 13*a*.

If the reject unit 12 and the sorting units 13*a* and 13*b* used as references have different sizes, the one having the largest set transfer interval is preferably used as a reference.

The coins C delivered to the coin transfer section 9 are determined by the identifying unit 11 as to whether they are genuine or counterfeit and as to the denomination and then counted.

Of the coins C transferred by the coin transfer section 9, those determined as not genuine are diverted by the reject unit 12 into the reject box 20.

On the other hand, those coins C that have not been rejected are transferred toward the sorting units 13*a* to 13*c* downstream of the reject unit 12, and based on a determination result by the identifying unit 11, are sorted by the sorting unit 13*a* or the sorting unit 13*b*. Those coins C that have not been sorted by the sorting unit 13*a* or the sorting unit 13*b* are transferred to the sorting unit 13*c*.

Then, the coins C fall through the sorting-out holes 14*a*, 14*b*, and 14*c* of the sorting units 13*a*, 13*b*, and 13*c* into the temporary retention units 21*a*, 21*b*, and 21*c*.

Sorting control in the above-described reject unit 12 and the sorting units 13*a* and 13*b* will be described below in detail by way of example of the sorting unit 13*a*.

Since the transfer speed of coins C by the coin transfer section 9 is known, the transfer distance of coins to be sorted into the temporary retention unit 21*a* is calculated by the control unit 26 based on an elapsed time.

In addition, the control unit 26 determines that a coin C which is detected by the reach sensors 16*a* when a period of time reasonable to detect that coin C has passed is the coin to be sorted.

Furthermore, in the control unit 26, when a coin C serving as a coin to be sorted is determined, it is further determined based on a detection result by the passage sensors 17*a* whether or not the upstream edge of the coin C, that has not been sorted, one coin downstream of the coin C in question is located downstream from the upstream edge of the stepped portion 35 formed on the gate 15*a*.

Thereafter, as shown in FIG. 2B, if it is determined that the upstream edge of the coin C is located downstream from the upstream edge of the stepped portion 35 and that the time is late enough to allow the upstream end of the coin C to be located in the stepped portion 35 when the gate 15*a* is switched to an open state, then the control unit 26 performs open control of the gate 15*a*, and as a result of the gate 15*a* being opened, the coin C as a coin to be sorted is guided into the sorting-out hole 14*a* and reserved in the temporary retention unit 21*a*.

At this time, even if the guide plate 32 of the gate 15*a* moves up, the downstream coin C is received in the stepped portion 35 and is transferred without pressing up the feed belt B.

On the other hand, if it is determined that the upstream edge of the coin C is not located downstream of the upstream edge of the stepped portion 35, that is, the upstream end of the coin C cannot be positioned in the stepped portion 35, the control unit 26 performs control in response to abnormalities, such as terminating transfer operation, assuming that a problem such as a transfer jam occurs.

Furthermore, after the coin C to be sorted has been stored into the temporary retention unit 21*a*, the control unit 26 performs close control of the gate 15*a*, for example, when the subsequent coin C not to be sorted is detected by the reach sensors 16*a*.

When the gate 15*a* is switched to a closed state, the coin C passes through the gate 15*a* toward downstream of the sorting unit 13*a*.

The above embodiment has been described by way of example of the sorting unit 13*a*. Similarly, open/close control of the gate 15*d* is performed based on an identification result by the identifying unit 11 and detection results by the reach sensors 16*d* and the passage sensors 17*d* in the above-described reject unit 12. Furthermore, open/close control of the gate 15*b* is performed based on an identification result by the identifying unit 11 and detection results by the reach sensors 16*b* and the passage sensors 17*b* in the sorting unit 13*b*.

Open/close control of these gates 15*d* and 15*b* is the same as that by the above-described sorting unit 13*a*, and hence a detailed description thereof will be omitted.

On the other hand, coins C that have not been sorted by the reject unit 12, the sorting unit 13*a*, or the sorting unit 13*b* are transferred to the sorting unit 13*c* disposed at a most downstream portion of the coin transfer section 9 and caused to fall through the sorting-out hole 14*c* into the temporary retention unit 21*c*.

Also in this sorting unit 13*c*, if it is determined that a problem such as a jam occurs based on a detection result by the reach sensors 16*c*, control in response to abnormalities is carried out in the same manner as with the above-described sorting units 13*a* and 13*b*.

Therefore, according to the above-described embodiment, even if the gates 15*a*, 15*b*, and 15*d* are tilted to raise the upstream ends thereof while the upstream end of a coin C transferred by the coin transfer section 9 is located on the gates 15*a*, 15*b*, and 15*d*, the upstream end of the coin C can be positioned in the stepped portion 35 formed on the upper surface of the guide plate 32.

Consequently, the gates 15*a*, 15*b*, and 15*d* do not lift the coin C and therefore can prevent the coin C from pressing up the feed belt B.

Figure 5A:
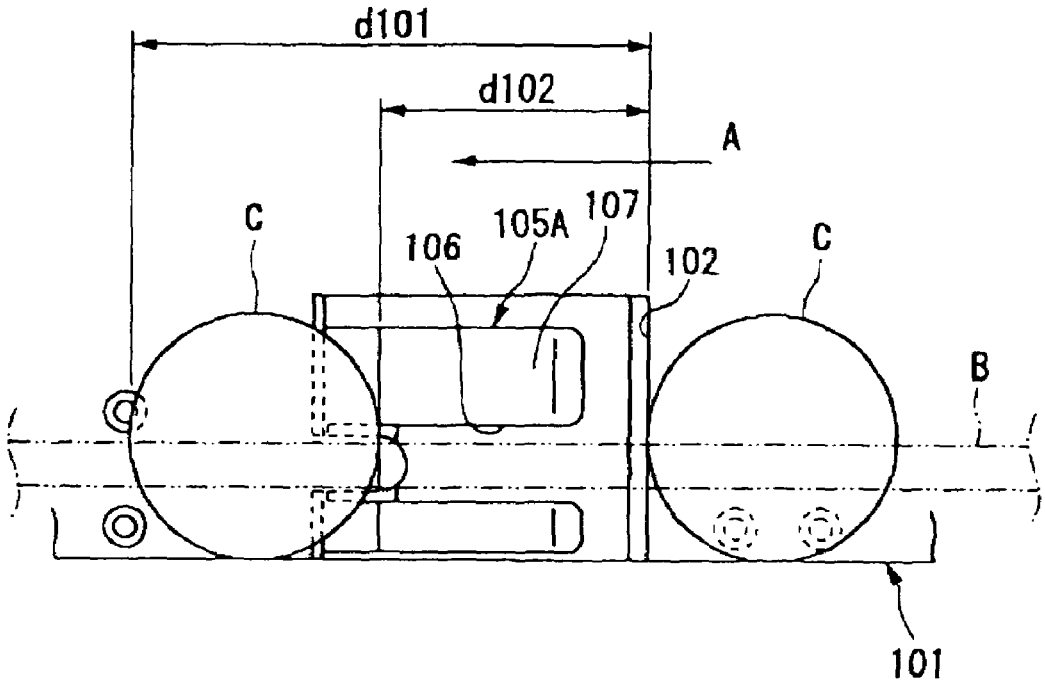
FIG. 5A is a schematic plan view of a gate of a coin processing device.
Figure 5B:
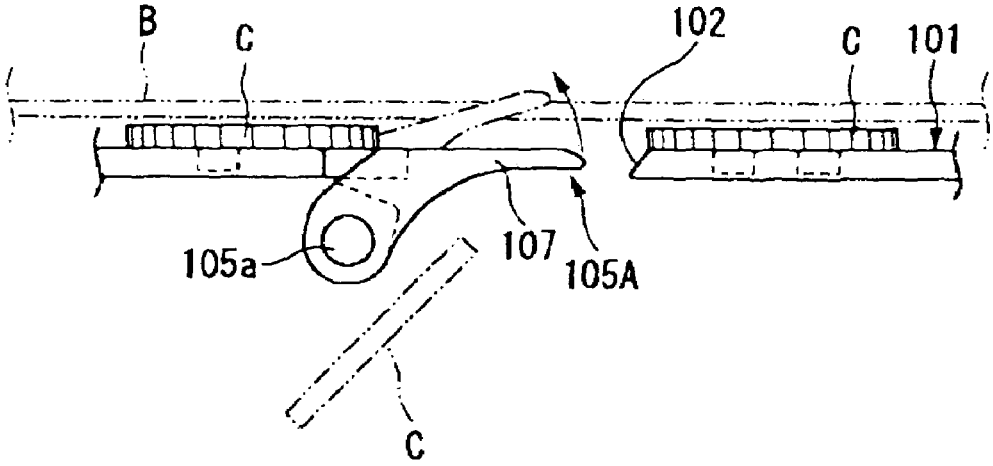
FIG. 5B is schematic side view of a gate of a coin processing device.

As a result, the transfer interval d2 and the transfer pitch d1, which are reduced by the amount of a length d3 in the transfer direction of the stepped portion 35 compared with the transfer interval d102 and the transfer pitch 101 of the known art shown in FIG. 5A, can be employed as shown in FIG. 2A.

For this reason, the coin processing capability per unit of time can be improved.

More specifically, assuming that, for example, the speed of the feed belt B is 60,000 mm/min, the transfer interval requires 27.92 mm, and the largest of coins C to be processed has a diameter of 25.8 mm in the known art, the transfer pitch is 53.72 mm, which results in a throughput of 1,116 coins (=60,000/53.72) per minute. According to this invention, a throughput of 1,348 coins (=60,000/44.48) per minute can be achieved without increasing the speed of the feed belt B, that is, merely by reducing the transfer interval of the coins C by the length d3 (e.g., 9.24 mm=27.92−18.68) in the transfer direction of the stepped portion 35.

It should be noted, however, that the above-described numbers of coins to be processed assume an efficiency of 100%.

It is advantageous if the bottom surface 35*a* is longer in the transfer direction, because the greater the length of the bottom surface 35*a* in the transfer direction, the more the transfer interval of coins C can be reduced. However, the greater the length of the bottom surface 35*a*, the shorter the distance between the stepped portion 35 and the guide surface 34, and therefore, it is preferable that the length of the bottom surface 35*a* in the transfer direction be the largest possible, so long as the robustness of the guide plate 32 is ensured and transfer operation is not adversely affected.

In addition, since the gates 15*a*, 15*b*, and 15*d* include the guide plate 32 supported by the shaft disposed adjacent to the portions of the sorting-out holes 14*a*, 14*b*, and 14*d* which are closer to the downstream-end of the coin transfer section 9, a simple structure can be achieved without making the gates 15*a*, 15*b*, and 15*d* complicated in shape. This contributes to preventing an increase in cost.

Furthermore, due to the passage sensors 17*a*, 17*b*, and 17*d*, a coin C can be detected located at a position where it is not pressed up by the gates 15*a*, 15*b*, and 15*d*. Therefore, the tilting of the gates 15*a*, 15*b*, and 15*d* can always be controlled to prevent the coin C from being pressed up. This increases the reliability.

In addition, since the position of a coin C, whether before or after the gates 15*a*, 15*b*, and 15*d*, can be correctly detected by using the reach sensors 16*a*, 16*b*, and 16*d* and the passage sensors 17*a*, 17*b*, and 17*d*, the open/close timing of the gates 15*a*, 15*b*, and 15*d* can be controlled with high accuracy by the control unit 26. This further increases the throughput and the reliability.

Although the current embodiment has been described by way of an example where the stepped portion 35 of each of the gates 15*a*, 15*b*, and 15*d* is composed of a horizontal bottom surface 35*a* and a longitudinal surface 35*b* extending upward substantially perpendicular to this bottom surface 35*a*, this invention is not limited to the stepped portions 35 with such a structure.

A stepped portion 35 with any structure is acceptable so long as the stepped portion 35 can receive an upstream end of the coin C.

What is claimed is:

1. A coin processing device comprising:

a horizontally extending passage to transfer coins one by one;

an opening formed on the passage;

a feed belt disposed above and extending along the passage;

guide plate which is tiltable between a horizontal position to close the opening and an upward position to open the opening and which includes an upper surface which forms a part of the passage when the guide plate is in the horizontal position and a lower surface which intercepts the passage so as to guide and allow the coins to fall into the inside of the opening when the guide plate is in the upward position, wherein the guide plate includes a slit to accommodate the belt; and a stepped portion formed on the upper surface to partly receive a coin, which is being transferred on the passage so as not to push up the coin out of the passage when the guide plate is tilted to the upward position, wherein the stepped portion has a bottom surface that is substantially flush with an upper surface of the passage when the guide plate is in the horizontal position.

2. The coin processing device according to claim 1, further comprising:

a sensor which is provided at a downstream side relative to the guide plate for sensing coins, which are being transferred at predetermined intervals on the passage; and a control unit which, in response to sensing results by the sensor, tilts the guide plate to the upward position when or after a coin has passed a position wherein said coin is to be partly received in the stepped portion.

* * * * *